US010221737B2

(12) United States Patent
Hebel et al.

(10) Patent No.: US 10,221,737 B2
(45) Date of Patent: Mar. 5, 2019

(54) EXHAUST SYSTEM HAVING VARIABLE EXHAUST GAS PATHS

(71) Applicant: Bayerische Motoren Werke Aktiengesellschaft, Munich (DE)

(72) Inventors: Peter Hebel, Gachenbach (DE); Timo Kresse, Aichwald (DE); Dieter Hable, Erding (DE); Franz Matzke-Neumair, Biberbach (DE); Harald Mitschke, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 60 days.

(21) Appl. No.: 15/351,493

(22) Filed: Nov. 15, 2016

(65) Prior Publication Data

US 2017/0058732 A1 Mar. 2, 2017

Related U.S. Application Data

(63) Continuation of application No. PCT/EP2015/055305, filed on Mar. 13, 2015.

(30) Foreign Application Priority Data

May 16, 2014 (DE) ..... 10 2014 209 313

(51) Int. Cl.
*F01N 1/08* (2006.01)
*F01N 1/16* (2006.01)
*F01N 13/02* (2010.01)

(52) U.S. Cl.
CPC ..... *F01N 1/083* (2013.01); *F01N 1/08* (2013.01); *F01N 1/089* (2013.01); *F01N 1/168* (2013.01);
(Continued)

(58) Field of Classification Search
CPC . F01N 1/08; F01N 1/083; F01N 1/089; F01N 1/168; F01N 13/02; F01N 2240/36;
(Continued)

(56) References Cited

U.S. PATENT DOCUMENTS 4,913,260 A 4/1990 Fallon
5,280,143 A * 1/1994 Kakuta ..... F01N 1/10 181/250
(Continued)

FOREIGN PATENT DOCUMENTS

CN 2514120 Y 10/2002
CN 1858412 A 11/2006
(Continued)

OTHER PUBLICATIONS

International Search Report (PCT/ISA/210) issued in PCT Application No. PCT/EP2015/055305 dated May 13, 2015 with English translation (Six (6) pages).
(Continued)

*Primary Examiner* — Audrey K Bradley
(74) *Attorney, Agent, or Firm* — Crowell & Moring LLP

(57) ABSTRACT

An exhaust system for internal combustion engines has an exhaust tract, which has at least one first flow path and a second flow path for an exhaust gas stream. The first and the second flow path extend fluidically separated from each other from a pre-silencer to at least one end silencer. Depending on the rotational speed of the engine, the first flow path can be continuously closed by way of a controllable flap, wherein the exhaust gas stream is guided through the second flow path when the flap is closed.

11 Claims, 3 Drawing Sheets

(52) U.S. Cl.
CPC ..... *F01N 13/02* (2013.01); *F01N 2240/36* (2013.01); *F01N 2470/02* (2013.01); *F01N 2470/14* (2013.01); *F01N 2470/16* (2013.01); *F01N 2470/24* (2013.01); *F01N 2590/04* (2013.01)

(58) Field of Classification Search
CPC ..... F01N 2470/02; F01N 2470/14; F01N 2470/16; F01N 2470/24; F01N 2590/04
See application file for complete search history.

(56) References Cited

U.S. PATENT DOCUMENTS

| | | | | |
|---|---|---|---|---|
| 5,614,699 | A | 3/1997 | Yashiro et al. | |
| 5,739,483 | A | 4/1998 | Yashiro et al. | |
| 6,598,390 | B2 * | 7/2003 | Chang | F01N 1/006 181/227 |
| 6,938,729 | B2 * | 9/2005 | Worner | F01N 1/166 181/232 |
| 7,337,609 | B2 * | 3/2008 | Mahnken | F01N 1/165 181/237 |
| 2006/0000205 | A1 | 1/2006 | Bozmoski et al. | |
| 2006/0162995 | A1 | 7/2006 | Schorn et al. | |

FOREIGN PATENT DOCUMENTS

| | | | |
|---|---|---|---|
| CN | 202417671 | U | 9/2012 |
| DE | 10 2005 029 279 | A1 | 1/2006 |
| DE | 10 2005 003 582 | A1 | 8/2006 |
| DE | 20 2010 012 100 | U1 | 3/2011 |
| EP | 0 525 668 | A1 | 2/1993 |
| EP | 1 978 218 | A | 10/2008 |
| EP | 2 808 507 | A2 | 12/2014 |

OTHER PUBLICATIONS

German-language Written Opinion (PCT/ISA/237) issued in PCT Application No. PCT/EP2015/055305 dated May 13, 2015 (Seven (7) pages).

German-language Search Report issued in counterpart German Application No. 10 2014 209 313.9 dated Nov. 12, 2014 with partial English translation (Twelve (12) pages).

Chinese-language Office Action issued in counterpart Chinese Application No. 201580008091.6 dated Feb. 11, 2018 with English translation (fourteen (14) pages).

Chinese-language Office Action issued in counterpart Chinese Application No. 201580008091.6 dated Aug. 29, 2018 with English translation (11 pages).

* cited by examiner

EXHAUST SYSTEM HAVING VARIABLE EXHAUST GAS PATHS

CROSS REFERENCE TO RELATED APPLICATIONS

This application is a continuation of PCT International Application No. PCT/EP2015/055305, filed Mar. 13, 2015, which claims priority under 35 U.S.C. § 119 from German Patent Application No. 10 2014 209 313.9, filed May 16, 2014, the entire disclosures of which are herein expressly incorporated by reference.

BACKGROUND AND SUMMARY OF THE INVENTION

The invention relates to an exhaust system for internal combustion engines, preferably for motorcycles, having an exhaust tract that has at least one first flow path and a second flow path for an exhaust gas stream, wherein the first and the second flow path extend fluidically separated from each other from a pre-silencer to an end silencer.

More and more severe legal restrictions are being imposed on the noise generated by motorcycles. The noise level of a motorcycle is tested at standstill as well during a drive-by test as the motorcycle accelerates. High-powered motorcycles in particular are subject to the problem that the exhaust gas flow must be severely restricted to stay under the legal noise limit, which leads to a significant reduction in performance and an undesired restriction of the engine torque.

In order to obtain high performance at high speeds and a simultaneously reduced noise level at low speeds, exhaust systems known from prior art have a flap arranged in the flow path, which limits the exhaust gas stream as a function of speed. With this method, however, it is a disadvantage that at all times, the entire exhaust gas stream is affected and the flow experiences strong turbulence when the flap is partially open, which has a negative impact on the torque curve. Also, to achieve future noise level limits, the exhaust gas stream has to be limited in the speed range of the noise level measurement to such an extent that the desired performance would no longer be achieved.

Given this background, the object of the invention is to provide an exhaust system for high-performance motorcycles, the acoustics of which meets the legal requirements and which simultaneously delivers the desired power and torque curve across the entire speed range.

These and other objects are achieved by an exhaust system for internal combustion engines having an exhaust tract which has at least one first flow path and one second flow path for an exhaust gas stream. The first and second flow paths extend fluidically separated from each other from a pre-silencer to at least one end silencer. The first flow path is continually closable by a controllable flap as a function of speed, with the exhaust gas stream flowing through the second flow path when the flap is closed.

According to the invention, it is therefore provided to provide two flow paths for the exhaust gas stream, wherein, as a function of speed, exhaust gas flows through one or the other, and/or in part also through both. At low engine speeds, such as less than 5,000 rpm, for example, the flap is closed in the first flow path so that the exhaust gas stream flows from the pre-silencer via the second flow path to the end silencer without being hindered by a flap and at an optimal flow. In doing so, a flow-through mass and a flow-through speed of the exhaust gas are reached which ensure sufficient power and sufficient torque in the lower speed range. At the same time, the noise developed is sufficiently low to satisfy the legal requirements.

As the speed continues to increase, the flap continues to open so that the exhaust gas flows from the pre-silencer also through the first flow path. At high speeds and high power output, the flap is completely open and the exhaust gas stream flows essentially through the first flow path. A small part additionally flows through the second flow path. It is possible to influence the noise development directly by controlling the flap, wherein unlimited flow through the second flow path is provided at all times. It is therefore possible to divide the flow paths into an acoustically optimized path at low speeds and a power-optimized path for high speeds.

One embodiment of the invention provides that a flow diameter area of the first flow path, which is designed for high performance, is larger than a flow diameter area of the second flow path.

In a further embodiment of the invention, the first and second flow paths extend between pre- and end silencers, separate from each other and arranged side-by-side. In a further embodiment of the invention, the first and second flow paths extend coaxially in one another, with the second flow path surrounding the first flow path in a spaced apart fashion and the space between the first and second flow path forming the flow diameter area of the second flow path. The flow paths are generally formed by pipes so that the first flow path can be realized as an internal pipe within a larger external pipe (second flow path). The space between the external wall of the internal pipe and the internal wall of the external pipe determines the flow diameter area of the second flow path. The inner diameter of the internal pipe determines the flow diameter area of the first flow path. In an embodiment where flow paths are separated from each other and arranged side-by-side, appropriate pipes can be installed side-by-side, preferably in parallel.

The exhaust system includes the end silencer into which the first and second flow paths extend, wherein in one embodiment of the invention, the first flow path completely penetrates the end silencer in the direction of flow up to its outlet. The exhaust gas path therefore extends in the high-speed range directly through the first flow path to the outlet.

In an advantageous embodiment of the invention, it is provided that the second flow path ends in the end silencer in a chamber, which provides an instantly enlarged flow diameter area compared to the second flow path. The enlarged flow diameter area is realized, for example, by a large-volume chamber in the end silencer, through which the exhaust gas of the second flow path flows. In the case of the embodiment having an internal pipe in the external pipe, the internal pipe (first flow path) extends to the outlet and is surrounded by the volume of the end silencer, which clearly increases relative to the external pipe (second flow path). In the embodiment with flow paths arranged side-by-side, an area is provided in the end silencer next to the first flow path, which provides the volume enlargement in the form of a chamber.

In an economical embodiment of the invention, the exhaust system according to the invention is characterized in that the first flow path is fluidically connected to the chamber in the end silencer. In a preferred embodiment, this can be achieved in that the first flow path is perforated or developed with slots within the end silencer. When using a pipe as the first flow path, for example, the external wall area is provided with a multitude of holes or slots so that the exhaust gas can flow from the chamber in the end silencer into the first flow path and from there out of the outlet. The holes or slots are provided in an embodiment of the invention over the entire surrounding area so that in the end silencer, exhaust gas can flow into the pipe forming the first flow path over a length designed for the effectiveness.

In an embodiment of the invention, it is furthermore provided that the end silencer is divided by a separating element in the direction of flow, for example a wall element, wherein the chamber is provided in an upstream first section, and an insulator is provided in a downstream second section adjacent to the outlet. The insulator surrounds the first flow path. The insulation of the area adjacent to the outlet allows for a further shielding and defined reduction of the noise development. The noise development can be influenced once more with the size of the first and second section, with a favorable division being that, in a specific embodiment, the first section is two thirds and the second section is one third of the total length of the end silencer. A suitable insulator is conventional insulation wool.

Furthermore, the invention includes an exhaust system in which the two flow paths extend from the pre-silencer to two separate end silencers in the direction of the flow and one of the two flow paths can be closed and/or throttled by the flap.

The invention furthermore protects a motorcycle having an exhaust system that has a random combination of the characteristics represented above to the extent this is technically possible.

Other objects, advantages and novel features of the present invention will become apparent from the following detailed description of one or more preferred embodiments when considered in conjunction with the accompanying drawings.

BRIEF DESCRIPTION OF THE DRAWINGS

In all views, identical reference symbols refer to identical parts.

DETAILED DESCRIPTION OF THE DRAWINGS

Figure 1:
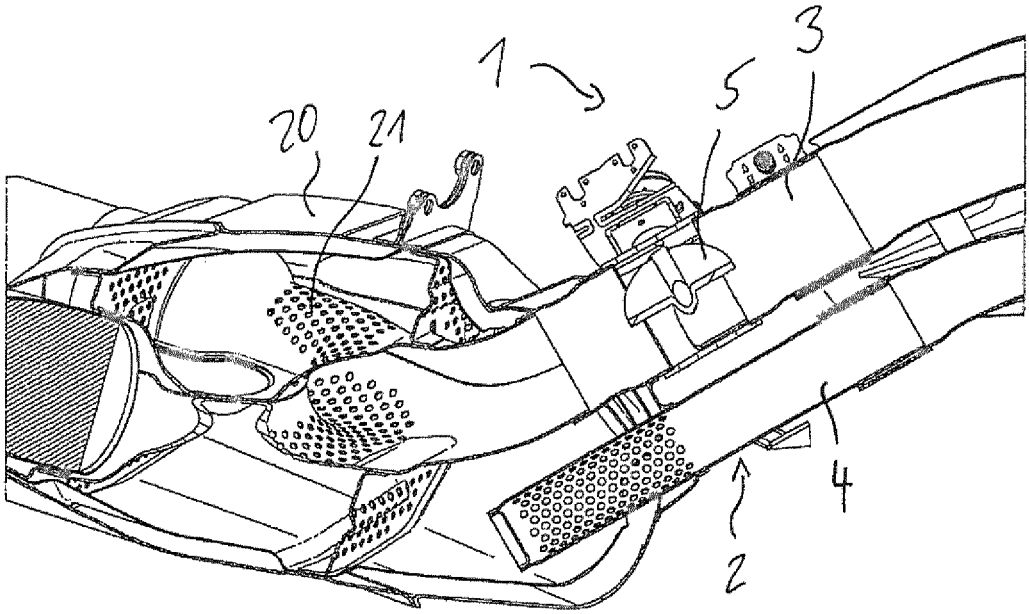
FIG. 1 shows an exhaust system with a parallel first and second flow path connected to a pre-silencer.

FIG. 1 shows a partially cut, perspective representation of an exhaust system 1 in a first embodiment having separate first and second flow paths 3, 4. Each flow path 3, 4 is developed as a pipe. The second flow path 4 is formed by a thinner pipe with a lesser flow diameter area relative to the pipe of the first flow path 3. Both flow paths 3, 4 extend from within the pre-silencer 20 and end in the end silencer 6 (see FIG. 2). Inside the first flow path 3 is a flap 5, which is controllable in a conventional fashion, by which the flow area of the first flow path 3 can be closed continuously as a function of speed and/or load. When the flap 5 is closed, the exhaust gas stream flows from the pre-silencer 20 essentially exclusively through the second flow path 4 to the end silencer 6. It goes without saying that the flap 5 does not completely seal off the first flow path 3, however, the restriction is sufficient for the significant portion of the exhaust gas stream to be guided through the second flow path 4. Via holes 21 and/or a perforation of the external walls, the two flow paths 3, 4 are fluidically connected to each other in the pre-silencer 20. In doing so, the pre-silencer 20 essentially acts as reflection silencer.

Figure 2:
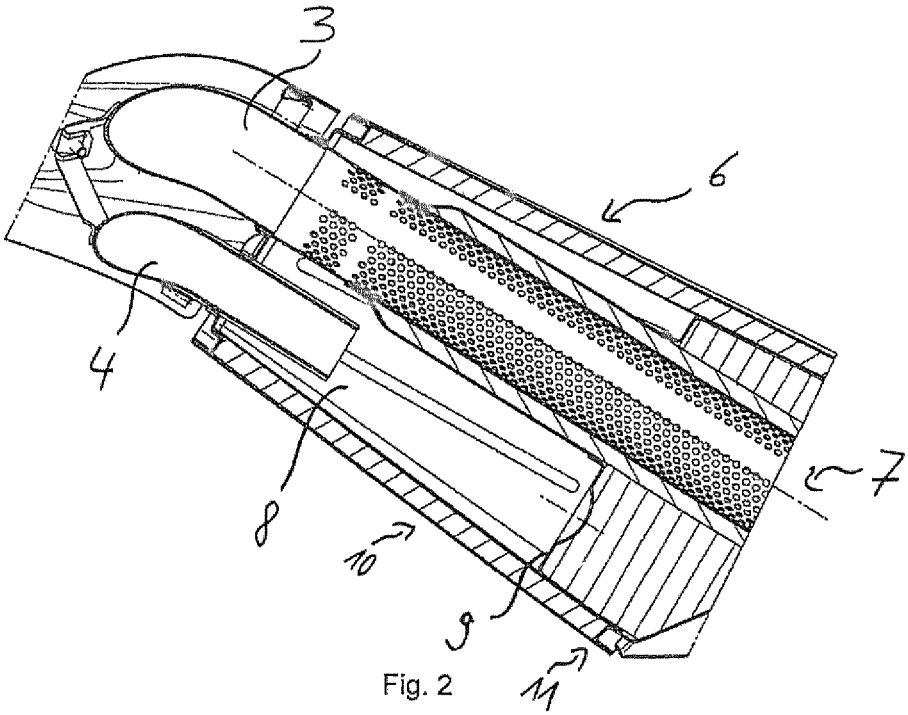
FIG. 2 shows the continuation of the exhaust system in FIG. 1 (area of the end silencer)
Figure 4:
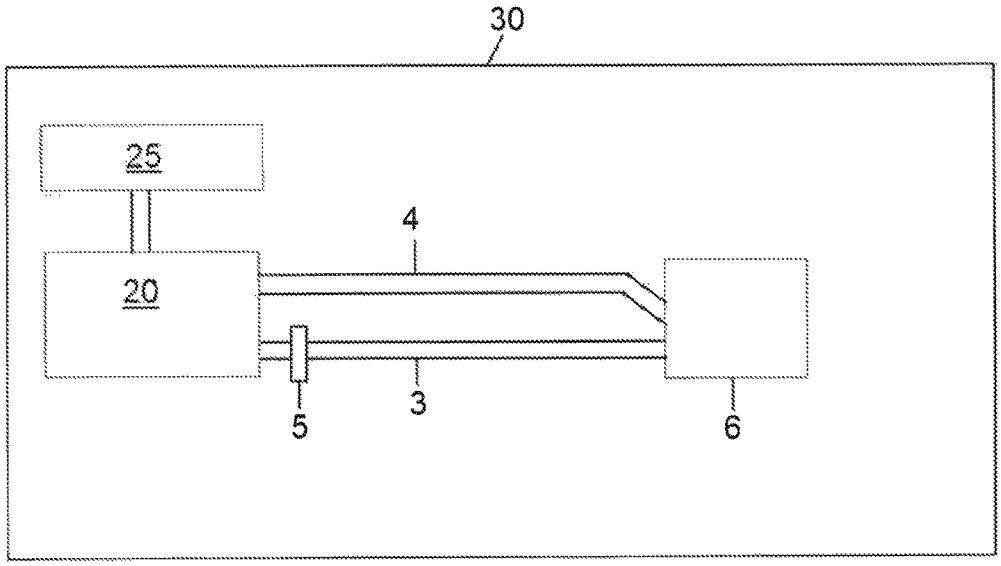
FIG. 4 schematically shows an embodiment of a motorcycle with an exhaust system in accordance with the present invention.

In the end silencer 6 according to FIG. 2, the first flow path 3 extends in the exhaust gas flow direction completely to the outlet 7. The second flow path 4 ends in a chamber 8, which provides a flow diameter area that is instantly enlarged relative to the second flow path 4. The enlarged flow diameter area is obtained in that the end silencer 6 has a diameter that is greater than the sum of the diameters of the first and second flow paths 3, 4, and the chamber 8 is developed by the space in the end silencer 6 which extends in an extension of the second flow path 4 and about the first flow path 3. Furthermore, in the embodiment shown, the diameter enlarges toward the outlet 7. Inside of the end silencer 6, the second flow path 4 is fluidically connected to the chamber 8 via a completely perforated development of the first flow path 3 (pipe). After the instant expansion of the exhaust gas of the second flow path 4 in the chamber 8, the exhaust gas flows via the perforation into the first flow path 3 and to the outlet 7. The end silencer 6 is divided in the direction of flow of the exhaust gas by a separating wall 9, so that an upstream first section 10 and a downstream second section 11 adjacent to the outlet 7, is developed. In the embodiment shown, the first section 10, when viewed in the direction of flow, is twice as long as the second section 11. In the downstream second section 11, insulation wool is provided, which surrounds the first flow path 3 and reduces the formation of noise at the outlet. The size of the chamber 8 can be determined by the position of the separating wall 9. The FIG. 2 arrangement is schematically shown in FIG. 4 with an engine 25 upstream of a pre-silencer 20 in a motorcycle 30.

Figure 3:
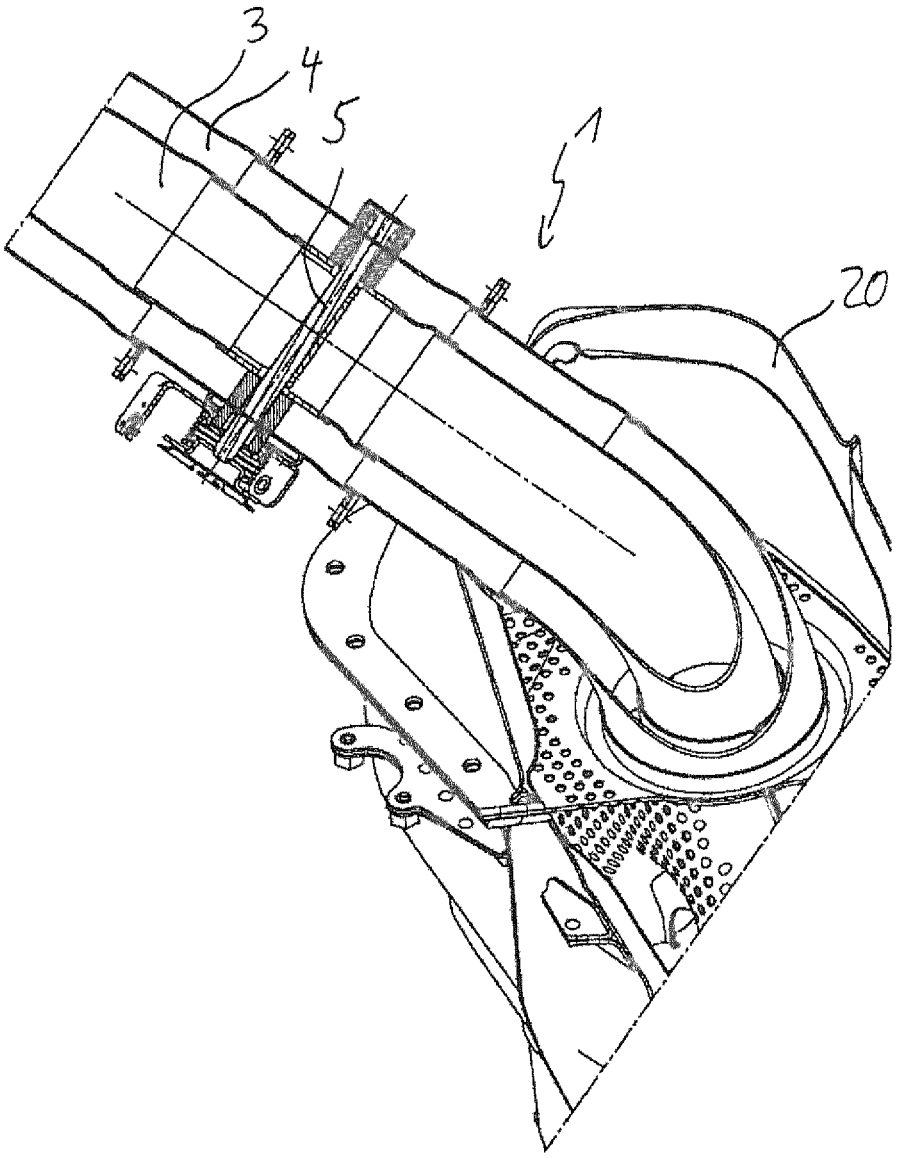
FIG. 3 shows an alternate embodiment of the exhaust system with a coaxial first and second flow path.

FIG. 3 shows a second embodiment of the exhaust system 1 in a perspective representation. The first and second flow paths 3, 4 are developed as concentric coaxial pipes, so that the second flow path 4 surrounds the first flow path 3 in a spaced apart fashion and the space between the first and second flow paths 3, 4 forms the flow diameter area of the second flow path 4. As with the embodiment in FIG. 1, the first and second flow paths 3, 4 are connected to the pre-silencer 20, with the exhaust gas stream from the pre-silencer 20 being led to both flow paths 3, 4 depending on the position of the flap 5. In the embodiment shown, the flow area of the first flow path 3 can be closed by way of the flap 5, as in FIG. 1. The exhaust gas then essentially flows exclusively via the second flow path 4 into the end silencer 6, in which the chamber 8 connects to the second flow path 4. The operating principle of the instant diameter enlargement in the end silencer 6 is identical to FIG. 1 except that the pipes of the flow paths 3, 4 do not extend side by side, but coaxially inside each other.

In both embodiments, the flap control is not shown. To that end, known solutions from the prior art can be employed.

The invention is not limited to the preferred exemplary embodiments described above. Rather, a number of variants are contemplated, which take advantage of the described solution even if the embodiments are principally different in type. For example, instead of a reflection silencer, it is also possible to use an absorption silencer as the end silencer, or the two single paths can end in two separate end silencers so that, for example, the power path extends on the left side and the acoustic path extends on the right side of the motorcycle.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust system for an internal combustion engine, comprising:

an exhaust tract having a first flow path and a second flow path for an exhaust gas stream;

a controllable flap;

a pre-silencer configured to receive the exhaust gas stream upstream of the first and second flow paths;

an end silencer; and a separating element arranged perpendicular to a flow direction of the exhaust gas stream in the end silencer such that the separating element defines a first upstream section and a second downstream section adjacent to an outlet of the end silencer, the separating element being configured to seal the first upstream section relative to the second downstream section, wherein the pre-silencer and the end silencer are spaced apart from one another by a portion of the exhaust tract not within a housing in which the first and second flow paths extend parallel to one another, the first and the second flow paths extend fluidically separated from each other from the pre-silencer to the end silencer, the second flow path ends in the first upstream section of the end silencer such that the exhaust gas stream from the second flow path enters the first flow path, the first upstream section is sized to provide a flow diameter area that is at least twice the size of a flow diameter area of the second flow path, and the first flow path is continually closable via the controllable flap as a function of engine speed, with the exhaust gas stream flowing through the second flow path when the controllable flap is closed.

2. The exhaust system according to claim 1, wherein a flow diameter area of the first flow path is larger than the flow diameter area of the second flow path.

3. The exhaust system according to claim 1, wherein the first and the second flow paths extend side-by-side in a parallel arrangement.

4. The exhaust system according to claim 1, wherein:

the first flow path extends inside the second flow path in a coaxial arrangement, and a space between an outer wall of the exhaust tract containing the first flow path and an inner wall of the exhaust tract containing the second flow path forms the flow diameter area of the second flow path.

5. The exhaust system according to claim 1, wherein:

the first and the second flow paths extend into the end silencer, and the first flow path penetrates the end silencer completely in a flow direction up to the outlet of the end silencer.

6. The exhaust system according to claim 1, wherein the first flow path is fluidically connected to the first upstream section in the end silencer by a perforated wall defining the first flow path within the end silencer.

7. The exhaust system according to claim 1, further comprising:

an insulator arranged in the second downstream section and surrounding the first flow path.

8. An engine system, comprising:

an internal combustion engine;

an exhaust tract having a first flow path and a second flow path for an exhaust gas stream;

a pre-silencer;

an end silencer;

a first flow path for exhaust gas;

a second flow path for the exhaust gas;

a controllable flap configured to open and close the first flow path as a function of engine speed; and a separating element arranged perpendicular to a flow direction of the exhaust gas stream in the end silencer such that the separating element defines a first upstream section and a second downstream section adjacent to an outlet of the end silencer, the separating element being configured to seal the first upstream section relative to the second downstream section, wherein the pre-silencer and the end silencer are spaced apart from one another by a portion of the exhaust tract not within a housing in which the first and second flow paths extend parallel to one another, the first and the second flow paths extend fluidically separated from each other from the pre-silencer to the end silencer, the second flow path ends in the first upstream section of the end silencer such that the exhaust gas stream from the second flow path enters the first flow path, the first upstream section is sized to provide a flow diameter area that is at least twice the size of a flow diameter area of the second flow path, and the exhaust gas flows through the second flow path when the controllable flap closes the first flow path.

9. The engine exhaust system according to claim 8, wherein the first and second flow paths are arranged side-by-side parallel to one another.

10. The engine exhaust system according to claim 8, wherein the first and second flow paths are arranged concentrically coaxially with respect to one another.

11. A motorcycle, comprising:

an internal combustion engine;

an exhaust system for the internal combustion engine, the exhaust system comprising:

an exhaust tract having a first flow path and a second flow path for an exhaust gas stream;

a controllable flap;

a pre-silencer configured to receive the exhaust gas stream upstream of the first and second flow paths;

an end silencer; and a separating element arranged perpendicular to a flow direction of the exhaust gas stream in the end silencer such that the separating element defines a first upstream section and a second downstream section adjacent to an outlet of the end silencer, the separating element being configured to seal the first upstream section relative to the second downstream section, wherein the pre-silencer and the end silencer are spaced apart from one another by a portion of the exhaust tract not within a housing in which the first and second flow paths extend parallel to one another, the first and the second flow paths extend fluidically separated from each other from the pre-silencer to the end silencer, the second flow path ends in the first upstream section of the end silencer such that the exhaust gas stream from the second flow path enters the first flow path, the first upstream section is sized to provide a flow diameter area that is at least twice the size of a flow diameter area of the second flow path, and the first flow path is continually closable via the controllable flap as a function of engine speed, with the exhaust gas stream flowing through the second flow path when the controllable flap is closed.

* * * * *